US007040059B2

(12) United States Patent
Hodsdon et al.

(10) Patent No.: US 7,040,059 B2
(45) Date of Patent: May 9, 2006

(54) METHOD AND ADJUSTABLE APPARATUS FOR ANCHOR-FREE MASONRY WALL BRACING

(76) Inventors: Edwin R. Hodsdon, 53 Turner Dr., North Monmouth, ME (US) 04265; Laurent E. Grenier, 97 Blake Rd., Monmouth, ME (US) 04259

( * ) Notice: Subject to any disclaimer, the term of this patent is extended or adjusted under 35 U.S.C. 154(b) by 0 days.

(21) Appl. No.: 10/716,090

(22) Filed: Nov. 18, 2003

(65) Prior Publication Data

US 2005/0072059 A1 Apr. 7, 2005

Related U.S. Application Data

(60) Provisional application No. 60/503,976, filed on Sep. 20, 2003.

(51) Int. Cl.
*E04G 21/00* (2006.01)
*E04G 21/26* (2006.01)

(52) U.S. Cl. ..... 52/127.2; 52/126.4; 52/126.6; 52/152; 52/645; 52/651.09; 52/652.1; 52/719; 248/200.1; 254/126; 254/128

(58) Field of Classification Search ..... 52/127.1, 52/127.2, 126.6, 146, 149, 152, 645, 651.09, 52/652.1, 719, 126.4, 652; 248/200.1; 254/126, 254/124, 9 C, 8 C, 2 C, 93 L
See application file for complete search history.

(56) References Cited

U.S. PATENT DOCUMENTS 3,817,006 A * 6/1974 Williams ..... 52/127.2
3,931,956 A * 1/1976 Hawkins ..... 254/8 B
4,000,592 A * 1/1977 Kelly ..... 52/149
4,068,427 A * 1/1978 Camardo ..... 52/127.2
4,070,833 A * 1/1978 Hancock ..... 52/148
4,088,303 A * 5/1978 Aquila ..... 254/88
5,040,637 A * 8/1991 Hawk ..... 187/206
5,692,731 A * 12/1997 Beauchamp ..... 254/124
5,862,637 A * 1/1999 Bruce ..... 52/147
5,956,906 A * 9/1999 Berich et al. ..... 52/149
6,062,545 A * 5/2000 Peavler ..... 254/418
6,205,719 B1 * 3/2001 Bruce ..... 52/147
6,256,939 B1 * 7/2001 Snyder ..... 52/126.6
6,336,892 B1 * 1/2002 Squibb ..... 482/23
6,550,188 B1 * 4/2003 Bolinger et al. ..... 52/127.2
6,655,097 B1 * 12/2003 Poolaw ..... 52/127.2
6,782,668 B1 * 8/2004 Bruce ..... 52/147

* cited by examiner

*Primary Examiner*—Jeanette E. Chapman

(57) ABSTRACT

Adjustable apparatus for bracing one or both sides of a wall being fabricated from masonry blocks and having an opening near the base of the block wall. Bracing system includes strong rigid members assembled in the form of a right angle brace set having stiff vertical, horizontal and diagonal members, a connector having a length sufficient to extend through the opening affixed at a right angle location of one or both of the brace sets. A pair of such braces—back to back, and spaced on opposite sides of a wall—are interconnected together via this connector. Selected brace members telescope to accommodate increases in wall height and a manually adjustable outrigger screwjack at the remote end of the horizontal member eliminates reliance on prior art deadmen.

5 Claims, 6 Drawing Sheets

METHOD AND ADJUSTABLE APPARATUS FOR ANCHOR-FREE MASONRY WALL BRACING

BACKGROUND OF THE INVENTION

Previous Filing Information

On Sep. 20, 2003 the United States Patent Office received a copy of—and assigned Ser. No. 60/503,976 to—a Provisional Patent Application (PPA) filed by the same inventors hereof. That PPA is incorporated herein by this reference as though set out here in full. Additionally, the PPA is being supplemented by this Regular Patent Application (RPA). Applicant expressly reserves all rights and privileges flowing from the PPA and its earlier official filing date and contents thereof. This RPA follows, and it is supported by the PPA.

FIELD OF THE INVENTION

This invention relates to masonry wall bracing and bracing systems for such wall. More specifically, the field of this invention relates to adjustable bracing anchored at a self-supporting base for safely assuring the construction of masonry walls. Additionally the field of this invention relates to a bracing system that sandwiches both sides of a wall under construction by a "connected-through-at-the-base" device which interconnects a pair of bookend right angle braces.

EXPLANATION OF TERMS

Our invention involves a pair of right angle adjustable braces abutting both sides of a wall under construction, and offers telescoping adjustments in plumb and height to selected brace members while the brace sets remain positioned against both sides of the wall. The novel system does so without the use of deadmen and all of the attendant disadvantages associated with such deadmen.

Set out below are brief descriptions of certain relevant terms which further the understanding of the invention. These terms provide a basis for a detailed teaching of the improvements of this invention in the relevant arts. Such terms are not intended to replace the claims but rather serve as helpful guides in understanding our novel improvements in these arts.

Concrete Pillars—or Deadman

Standard bracing approaches involve spaced right angle braces—often of wooden timbers—having a vertical member against the wall, an angled member and a horizontal base member running horizontally away from the wall to a gusseted footing plate that is bolted into a concrete pillar set in the ground. These pillars, or so-called "deadmen" each require about a cubic yard or more of concrete per anchoring point.

For example, the minimum dimension for a deadman as mandated for a 32 foot wall, must be about 3 feet across in both width and depth, and must be set into the ground a depth of about 3 and ½ feet. (The deadmen for shorter walls may be slightly smaller.) Earth moving equipment, or pick and shovel laborers, are mandatory to install and remove such deadmen. Each one is thus costly to set into place and even more costly to subsequently remove after wall construction is finished. In fact, when short spacing distances are required between bracing, the deadmen often take the form of a solid running concrete trench or bunker. These deadmen requirements pose significant disadvantages of the prior art.

Although such pillars/deadmen may be used, the invention does not require such deadmen.

Outrigger Screwjacks

Rather than use deadmen, the invention employs vertical oriented outrigger screwjacks that are adjustably connected at the outermost end of the base, or horizontal, leg of each of the angle braces. Such screwjacks may preferably take the form of a threaded riser formed above a foot plate in contact with the ground. The ground need only have a modicum of levelness and need not be trenched, framed and/or poured as is true for the deadmen requirements of the prior art.

Extending upward from the screwjack foot plate is a threaded shaft that mates with or passes through a receiving opening at about the outer end of the horizontal leg of the brace. A threaded locking wing is used to secure height adjustments made via this screwjack. Pipe clamps may also be used to hold the adjusted locking wing in place simply as an effort to deter vandalism which is sometimes encountered on construction sites. The outrigger screwjack takes the place of the cumbersome deadmen; and, by comparison, is far more economical, safe and convenient.

Base-Located Interconnector

A single connection hole is located through the base of the wall being built to hold a pair of braces together on opposite sides of the wall. This opening—being located at a block course just above the wall's foundation—does not significantly detract visually nor does it weaken the structures as do a series of vertical through openings typical of the prior art. Each brace of the invention, at the right angle location, is fitted with openings that receive a base connector. That connector may be in the form of a long threaded shaft, which shaft is passed through aligned openings in the brace pair and is fitted with nuts for tightening. As the threaded nuts are tightened, the vertical legs of a brace pair are drawn snugly against opposite sides of the wall. They, in turn, hold and support the masonry wall being.

Temporary Tie Wire

As a practical matter several courses of blocks will normally have been laid before the inventive brace(s) need be erected on the work site. At a height that may safely and easily be reached by a workman (e.g. standing on a ladder, for example) a short section of tie wire is inserted in one of the higher block courses being laid. This tie wire is vertically in line with the lower connector opening and need only be a short length of wire. Its primary function is simply to receive a few twists by a masonry craftsman around the vertical brace member, in order to temporarily hold the brace upright against the wall. This temporarily hold by our tie-wire assures that the vertical brace member will remain upright—thus physically freeing a workman so that our connector and leveler means may be appropriately adjusted.

Telescoping Members

Each vertical and angle (diagonal) brace member of the inventive opposing brace pair may preferably be formed from rugged telescoping steel square tubes that fit within each other. Telescoping of these members achieves length adjustments required for workmen protection as wall height progressively increases. Since the height of each newly laid wall section to be braced may be foreknown, the telescoped tubes are appropriately formed with drilled adjustment holes that are aligned so that they may receive connecting bolts or pins. The length of a brace member can easily be achieved from a scaffold or a ladder, and the two or more telescoped members (vertical and diagonal) may again be secured together after the required extension to the bracing system has been made. A telescoping bind bolt makes such adjustments easier and more economical.

BACKGROUND—DESCRIPTION OF PRIOR ART

Block walls include internal voids that are filled or "grouted" with wet cement at specified intervals along the wall being constructed. Such walls may soar to various heights in today's building environment. Once the first eight foot height is reached, OSHA mandates—and practical safety requires—that the block wall should be additionally braced. Four feet more of non-grouted masonry wall can be added above that first eight foot limit before more and higher bracing again becomes mandatory.

In effect, a block wall goes upward in eight foot increments and common sense safety requires that no more than four feet of non-grouted wall should be added without some additional safety bracing being applied to the construction zone. Construction of such walls also requires scaffolding for the masons. Such scaffolding is stationed at least on one, and often on both sides, of the wall. This invention provides ready scaffolding access for laying up blocks while assuring safety as wet grouting is being poured into the block voids. Indeed, the compact and ease of elevation of the vertical and diagonal members of our inventive brace pair allows workmen to readily accommodate course laying, internal grouting, and custom surface finishing together with an advanced improvement in worker safety as well.

From a standards point of view, construction of masonry walls places a burden on the mason contractor to support any masonry wall under fabrication that is over eight feet in height. Such walls must be "adequately" braced. Exactly how such bracing is to be performed, however, is left to the discretion of the contractor in accordance with the OSHA standards in effect today. In exercising that discretion for each and every bracing situation, wind factors are of paramount importance. Several of the typical prior art approaches will be discussed below. But first, a brief review of how wind affects the discretionary bracing environment is believed to be warranted.

Wind speed, with winds varying from calm to gale force constantly buffet a wall being laid up by courses of building blocks. The wind, of course, is never steady; rather, it whips around buildings which may be present and comes in bursts and gusts together with wind variations going from steady to shifting forces.

In short, masons must be protected from the cyclic wind loads that are created by the ever changing wind conditions. Otherwise, without adequate bracing, such winds will readily blow down a wall and endanger craftsman in the masonry trades. It is not unknown for workmen to be killed or seriously injured when walls are not adequately braced.

Any wall that has not yet been "cured" sufficiently is at risk unless it is adequately and safely braced. Indeed, such wall destruction happens in spite of the various prior art attempts to use strengthening members and prior art bracing sections as are commonly found in wall construction.

A block wall under construction is looked upon, for evaluation purposes, as comparable to the sail of a water craft. The well known Beaufort Wind Scale is deemed applicable and the various marine Beaufort numbers are deemed to apply to the Masonry Industry. While originally applicable only to wind conditions at sea, that Beaufort scale has been modernized and modified to take into accounts land affects.

The modified table below sets forth some of the relevant wind factors which must be taken into consideration.

TABLE

| Beaufort No. | Wind speed | Effects on Land |
|---|---|---|
| 0 | Calm | Smoke rises vertically. |
| 1 | 1–3 | Rising smoke drifts, weather vane is inactive. |
| 2 | 4–7 | Light Breezes: Leaves rustle, can feel wind on your face. |
| 3 | 8–12 | Gentle Breezes: Leaves and twigs move around. |
| 4 | 13–18 | Moderate Breezes: Moves thin branches. |
| 5 | 19–24 | Fresh Breezes: Trees sway. |
| 6 | 25–31 | Strong Breezes: Large tree branches move. |
| 7 | 32–38 | Moderate Gales: Large trees sway. |
| 8 | 39–46 | Fresh Gales: Twigs and Branches are broken from trees. |

Three common prior art methods are employed to try to safely brace walls in view of the varying wind conditions set out above. In the first method, wooden diagonally placed timbers were positioned at one end against the wall and such timbers at the other remote end are tied to a deadmen, or to posts driven in the ground. Vertical, horizontal and diagonal timbers are often nailed or screwed together in a rather helter skelter wooden jumble.

This wooden bracing method may also include wooden struts connected at the midpoint of the diagonal brace, which struts run toward the base of the wall being built. This wooden bracing is not at all acceptable. Such bracing is subject to cyclic loading from the wind forces and tends to become seriously weakened. Indeed, it is felt by some that this jumbled wooden approach of the prior art creates other serious safety hazards.

In short summary, this wooden timber jumble itself poses safety hazards such as sliding upward as the walls tend to move. Actual wooden brace sliding along the surface of a leaning wall may happen and failures result. Additionally, broken planks and splintered wood abounds. Such wooden bracing is both an attractive nuisance, dangerous in operation and "free" lumber is available for unauthorized taking.

Another typical prior art approach employs a vertical metal beam secured to the face of the wall and held in place by a series of bolts passing through the masonry blocks and the vertical beam itself. A Brace-rite system marketed under a Duro-o-wall trademark is one such prior art type, and it is described in detail in the Technical Bulletin 99-2 Unit Masonry manual incorporated herein as though set forth in full at this point.

The above-mentioned Brace-Rite type includes a bolted-through plate which causes serious wall damage and weakens the structural integrity of the wall. Moreover, it mars the outer masonry block surface—especially troublesome and costly when a decorative exterior wall finish is sought. This is a costly approach both to install and then later to remove. In particular, it creates increased finishing costs needed for removal and the subsequent repairs needed to cover the bolted through hole locations. Moreover, the system requires extra costs and suffers the numerous drawbacks of deadmen—which drawbacks are essentially eliminated by our invention.

Another prior art approach employs cables and turnbuckles anchored between deadmen and cable eyes secured at openings through the wall. Again the wall is damaged and the points of connection—although unwieldy—may not provide efficient support. These and other drawbacks of the prior art are set forth in various available publications including "Masonry Bracing" published by the Masonry Contractors Association—a July 2001 is of particular interest and it is incorporated herein as though set forth in full at this point.

The various shortcomings of these and other prior art approaches are overcome by our invention. Indeed, costing out a masonry job based upon prior art supporting techniques is several times higher than when our new and novel bracing system is employed. Additionally, and perhaps most important, is that worker deaths or injuries resulting from inadequate prior art bracing will be markedly reduced.

SUMMARY OF THE INVENTION

In the invention, each right angle brace includes a horizontal, vertical and diagonal member preferably fashioned from rigid steel tubing that may be interconnected by bolts and/or connecting pins into a stiff rigid right angle brace. Suitable coupling at the corners of the brace assures easy folding of these members so that the brace members are readily portable in sections by a single workman.

For example, the inner telescoping members may be separated from the receiving outer triangular telescope brace sections in order to provide for less weight and manual transport considerations. Once inserted, however, such telescoping members are bolted, pinned or otherwise suitably fastened together for on site bracing. In contradistinction to the prior art, the inventive right-angle brace sets are located, adjusted and compressively interconnected back-to-back on opposite sides of a wall under construction. The connector means is locked within the opening and such means may take any one of many different forms. In our embodiment(s) the connector/adjustment means may be spring loaded, winch-like or more simply a threaded steel shaft for adjustably connecting, leveling and interconnecting the braces of a back-to-back pair.

A connector is passed through a hole in the base of the wall and through aligned mating holes in the vertical riser at the right angle corner of each opposing brace of a support set. Such a threaded shaft may simply be secured by mating threaded nuts at the outside 90° corners of the two opposed braces. Manual tightening of such nuts (plus outrigger adjustment) brings the brace sets together in such a manner that the vertical risers of both of the brace sets are vertically aligned against the wall under construction.

Vertical oriented screwjacks located in receiving openings at the remote end of the horizontal outrigger, adjust for any unevenness at the construction site; and, when raised and lowered, assures that the vertical riser of each right angle brace set will be a flush fit securely against the masonry wall being braced. A flush fit by the vertical riser brace member assures workmen safety in a wall braced by our system.

Both the vertical riser and the diagonal legs of our novel right angle brace sets include telescoping rigid struts which allow for height adjustments to such bracing as is periodically mandated by increases in height during wall construction. A simple and novel twist wire is employed as a method of assembling and securing the right angle braces to the wall. This feature of the invention is free of bolts and holes of the prior art that mar or weaken the visible surface of a wall. No deadmen, posts or land anchors of any type are required for the interconnected opposed brace sets equipped with outrigger screwjacks in accordance with the principles of this invention.

The novel features of the disclosed invention provide many benefits. These benefits are achieved by an invention that:

- Meets or exceeds OSHA requirements.
- Is readily useable on small to large projects.
- Provides vertical adjustability in a simple and ready manner.
- Is easily transportable.
- Is easy to set up and/or breakdown thereby minimizing man hours and associated costs required for wall construction.
- Requires minimum material handling time for setup or removal.
- Involves minimum wall penetration to reduce man hours and man-lift time for setup and/or removal.
- Eliminates the use of deadmen, land anchors, anchor posts and the like together with their attendant disadvantages and costly installation and removal.

DRAWINGS

Figure 1:
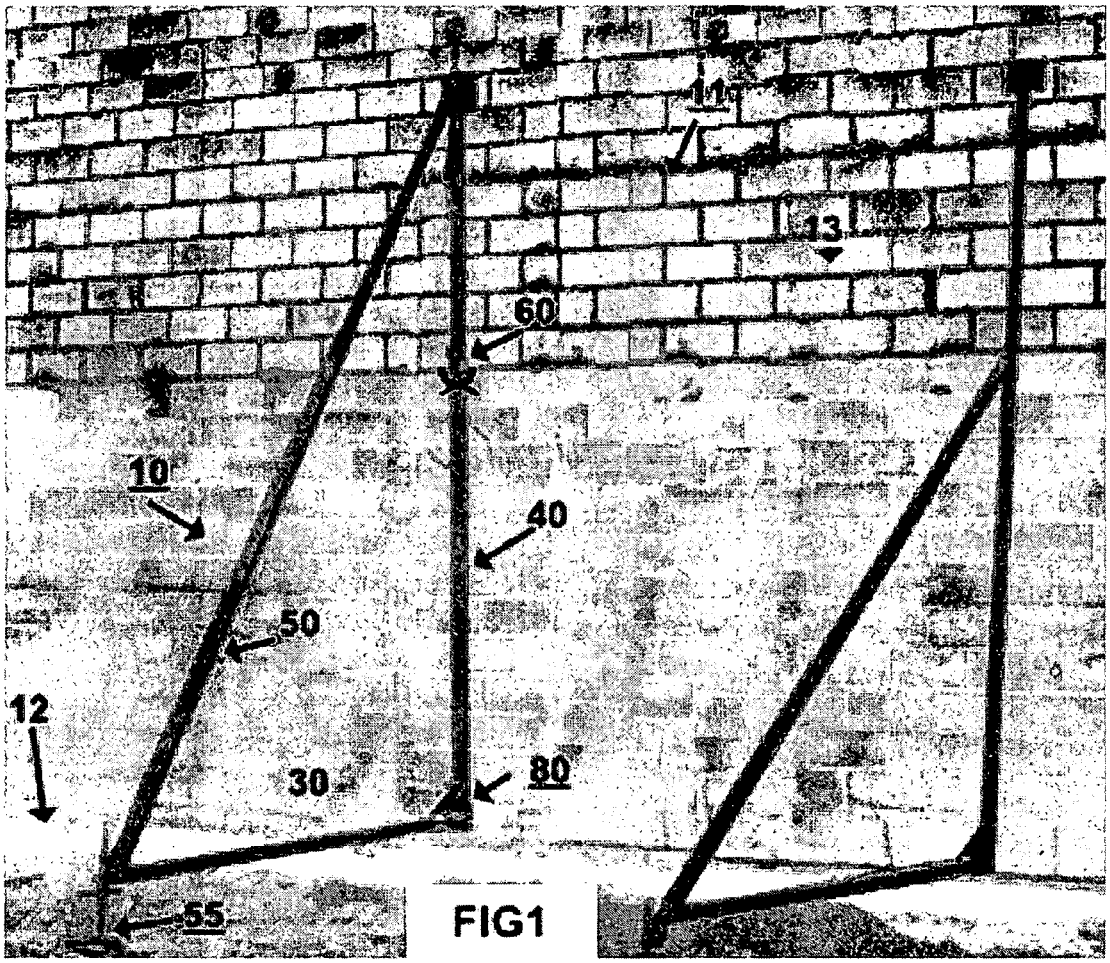
FIG. 1 is a perspective view of one embodiment of a wall brace constructed in accordance with the invention.
Figure 5:
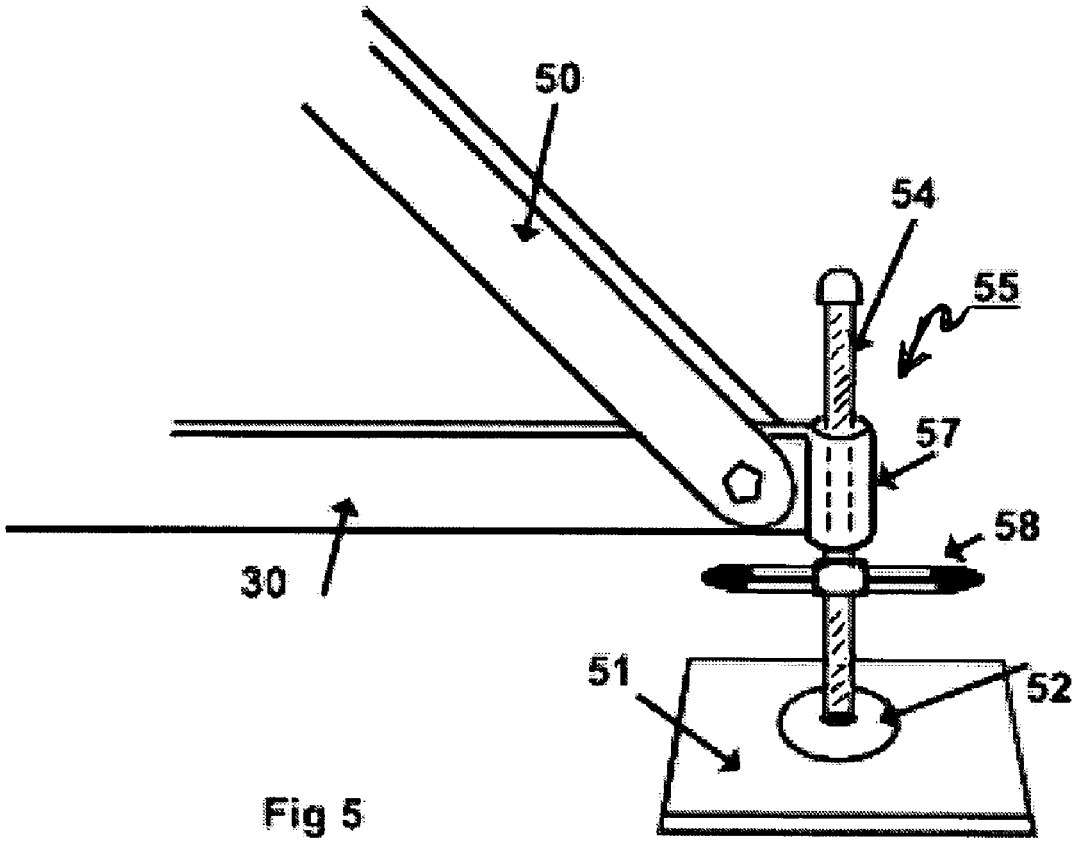
Figure 6:
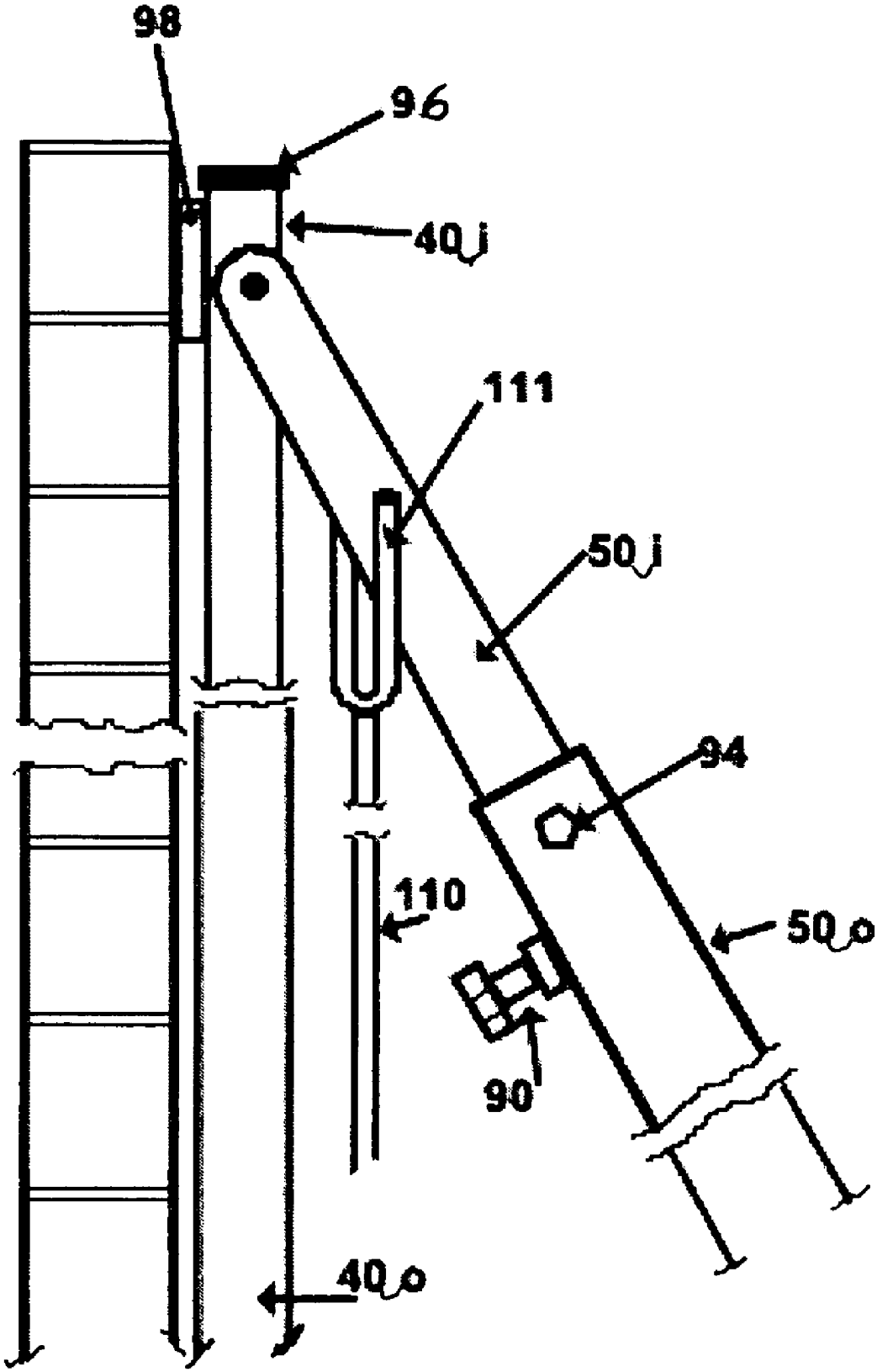

FIG. 5 includes is an enlarged view of an outrigger screwjack of FIG. 1; and FIG. 6 depicts the telescoping feature for the brace sets of this invention.

DETAILED DESCRIPTION OF THE PREFERRED EMBODIMENT

Figure 2:
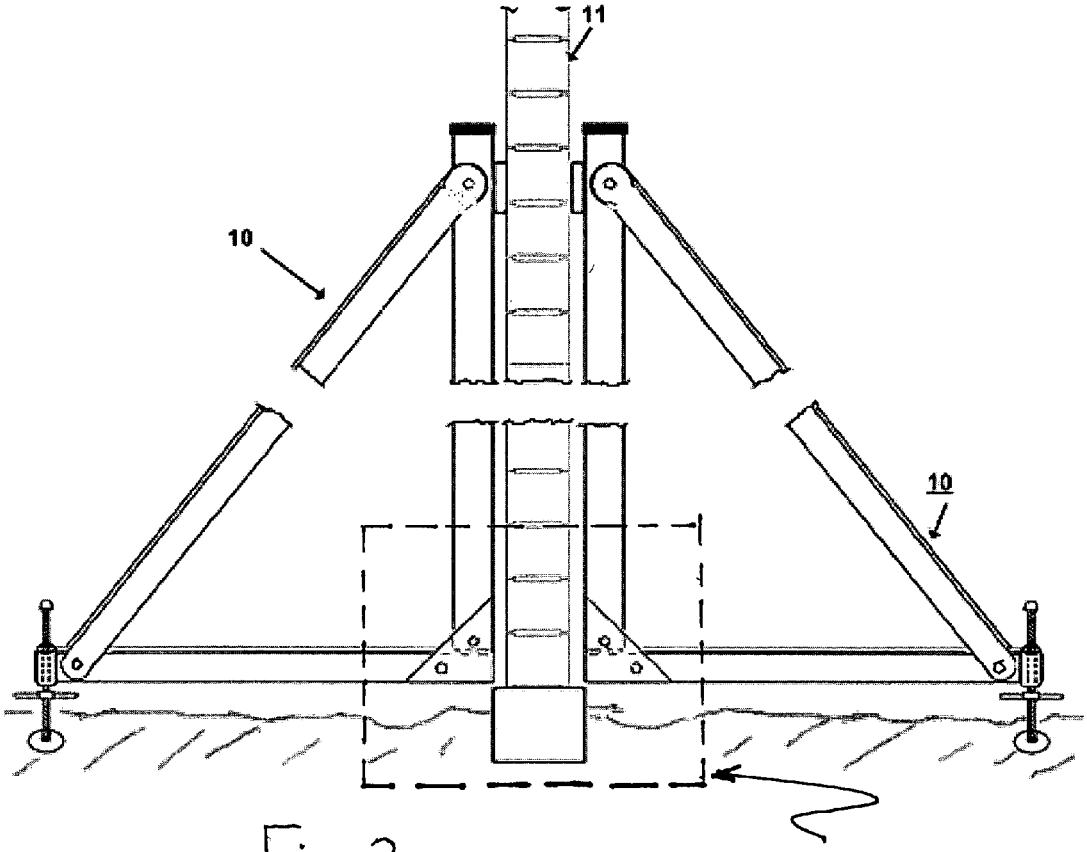
FIG. 2 shows an end view of a pair of supports of FIG. 1 placed on opposite sides of a wall.

FIGS. 1 and 2 are views helpful in fully understanding our bracing invention. Each brace 10 as shown is a unitary right angle brace, preferably formed from sturdy square tube steel members, which members are bolted, welded or otherwise assembled into a unitary right angle brace structure 10. A brace 10 is moved on site in separated member fashion and may be assembled while leaning on the ground. And then, the assembled frames is manually rotated (See FIG. 3) and held upright level and flush as will become clearer from the additional description of the invention.

While primarily intended to be employed in opposing pairs (See FIG. 2) our invention may, in a particular case, consist of a single right angle brace 10 held flush against a wall by adjustable connecting and leveling means (80 and 55, FIG. 1, respectively). Most often, however, our preferred embodiment is as shown in FIG. 2 depicting a pair of braces 10*a* and 10*b*, in back-to-back upright position aligned and held flush and plumb along a common vertical on opposite sides of a wall under construction.

A wall 11, as well known, is normally "laid up" to various heights by workers placing standard concrete block, layer upon layer, extending upward from a wall's base foundation. Each brace 10 of FIG. 1 has a horizontal member 30, vertical member 40 and an angled, or diagonal, member 50. These members may either be single non-telescoped pieces or they may be fabricated from one or more shorter sections which are telescoped together to accommodate differing wall heights and size requirements.

Comparison of the braces of FIG. 1 shows that the telescoped members 40 and 50 of the right hand brace have been elevated in order to accommodate and offer support for the increased height of wall 11. FIG. 1 also reveals that the telescoped members 40 and 50 of the left hand brace have both been extended as necessary to support the higher height of wall 10. Workmen on scaffolding (not shown, but provided for by the invention's close fit to the wall 11) simply lift the vertical and diagonal telescoping members 40, 50 as wall 11 increases in height.

In the method of practicing this invention hole 81 is either left or bored at about (or slightly above) the first block course at base 12 of a wall 11 to be fabricated. The steps in our invention will now be described in more detail.

Figure 4:
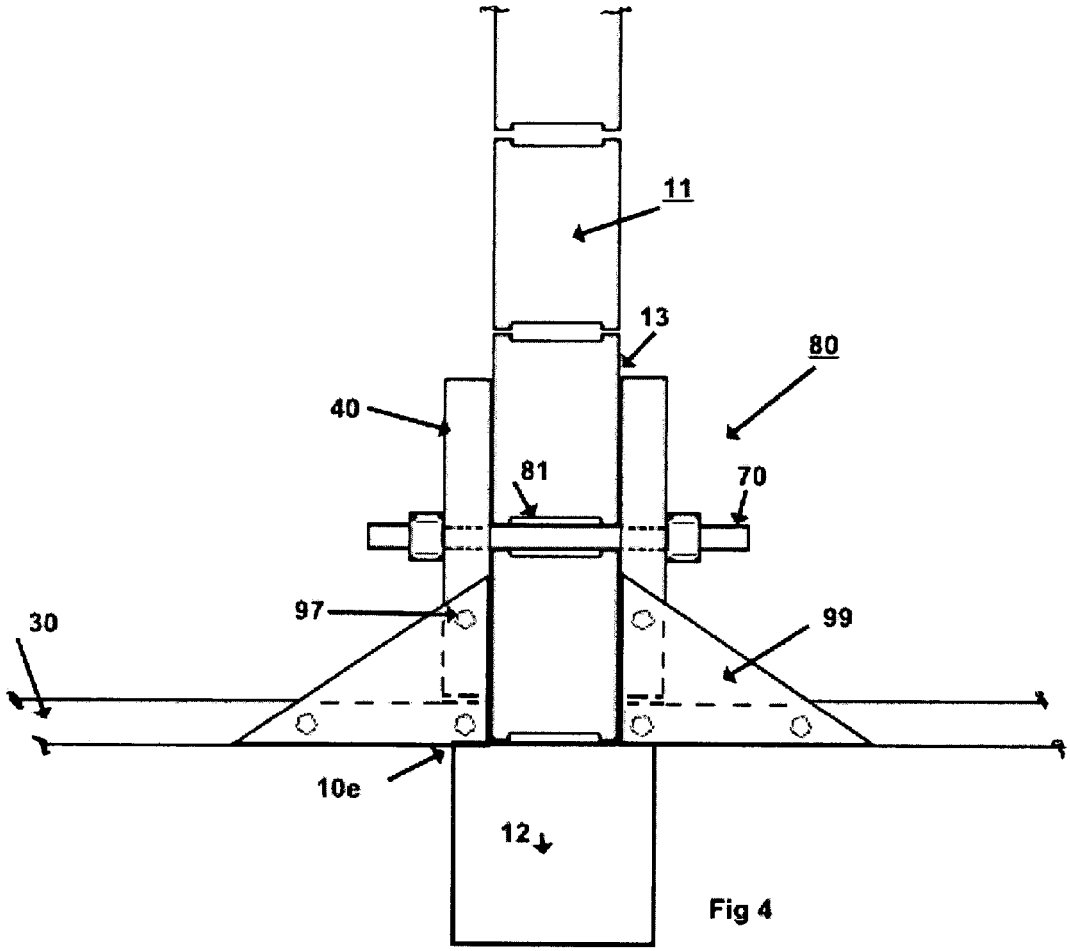
FIG. 4 shows a connector coupling a pair of opposed brace supports through an opening in a wall being fabricated.

It should be understood that the foundation 12 for a block wall 11 is often wider than the width of the individual blocks 13 which make up wall 11. FIG. 4 is an enlarged partial view at the base of the wall 11, which view shows a connector opening 81 for a pair of opposed brace sets on opposite sides of a wall 11. As shown, the innermost edge 10*e* of each brace set 10 of this invention may rest on the foundational overhang, while being interconnected to each other by threaded shaft 70 through opening 81 in the block wall 11. Rotation of the loosely connected brace set 10 will allow such a set to be placed on that edge 10*e* where it may then be secured as described further hereinafter.

Please note that the inner and outer telescoping members (FIG. 6) may be separated. That is to say, that the outer telescope housing 50*o* of the diagonal 50 may be slid away from the inner telescope 50*i*. The same is true for the vertical members 40*o* and 40*i*. Thus, these brace members may all be separable in order to lighten the portability load for a workman.

Figure 3:
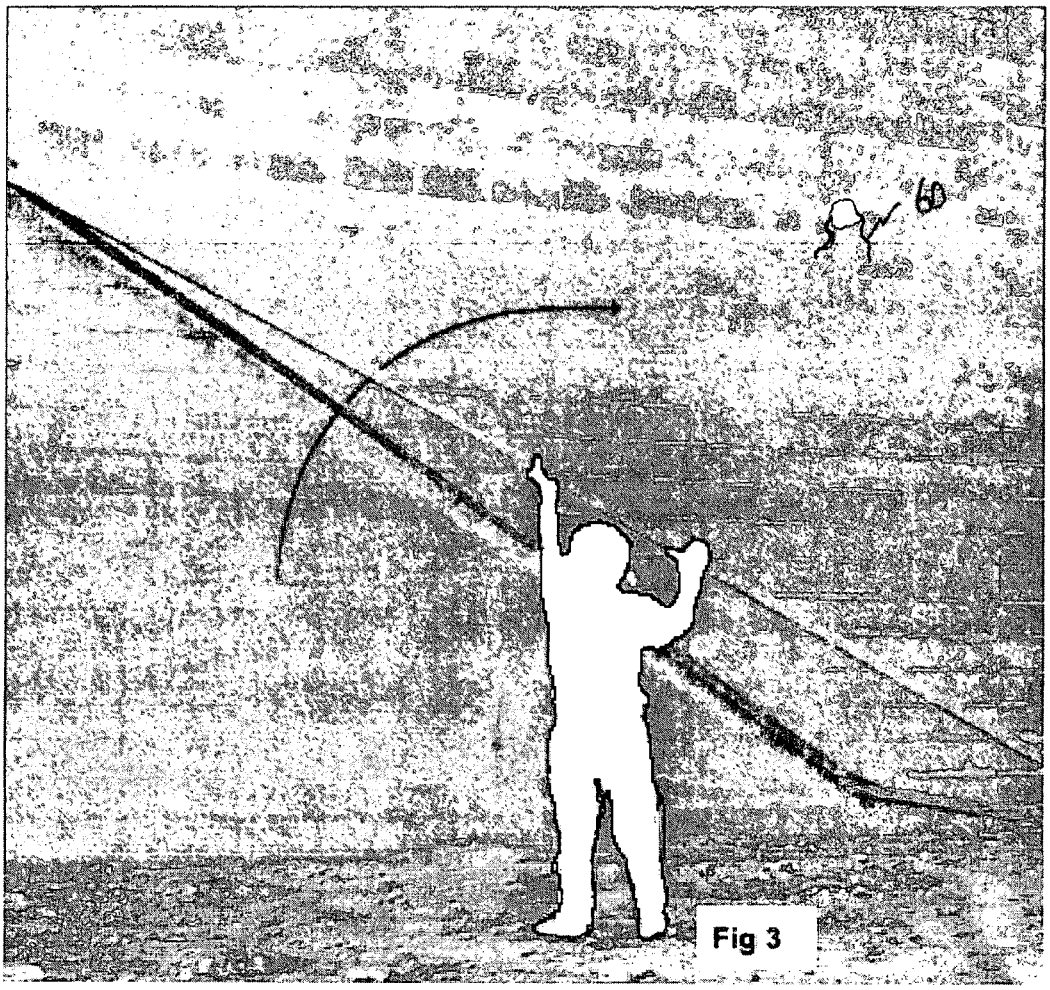
FIG. 3 depicts workmen rotating a brace set into an upright position for bracing a block wall in accordance with the method steps of this invention.

At first the individual members—singularly or in partially folded form—are carried to a site and are often there assembled and leaned on the ground loosely connected to each other through a connecting means—such as threaded shaft 70—at the base connector opening 81. Such members may then be pinned, bolted or otherwise fastened together to form a rigid unitary right angle brace 10 of the invention. FIG. 3 depicts a workman in the process of raising an assembled set 10, previously leaning on the ground, to an upright position.

Method steps, in summary, include tilting the assembled brace set 10 upright—the process being partially shown by FIG. 3. Then, the upright set is temporarily held in place via a tie wire 60. Then connector 80 and screwjack 55, FIG. 1, are adjusted and tightened so that the upright brace set will provide brace support to one or both sides of a wall 11.

Getting the rigid assembled brace set 10 upright and plumb involves rotation about an adjustable connecting means 80, leveling the horizontal and vertical members to their desired positions by height adjustments at element 55, and then maintaining same free of further manual assistance by a tie wire 60 as described in more detail below.

As a practical matter several courses of blocks will have already been laid on the wall before the bracing system of our invention need be erected for support of the wall. Above eye height, at a position that may easily be reached by a workman on a ladder, a short section of tie wire 60, FIG. 1, is inserted in a selected one of the block courses being laid. That wire 60 need only be a short length of wire, perhaps about haywire thickness. Preferably, although it need not be mandatory, this tie wire 60 will be wrapped around an internal vertical riser of reinforcing rod of the type commonly used in block wall construction.

The primary function of this tie wire 60 is simply to allow a workman to place a few twists about the vertical brace member 40 and hold that member 40—and, thus the entire rigid brace 10—upright in position against the wall 11. Twisted tie wire 60 temporarily holds the vertical upright in its proper place, and frees the workman from any further manual attention in holding brace 10 in place.

This invention, FIG. 5, provides a pair of outrigger screwjacks 55 (one screwjack for each brace set) to be adjusted in height such that the horizontal member(s) 30 are essentially level with the ground. As noted above in connection with the discussion of deadmen, the earth around construction sites is often neither level nor in good repair. The outrigger screwjacks 55 of our invention greatly alleviate such surface problems inasmuch as the screwjacks 55 of our invention include a foot plate 52 which readily accommodates uneven ground.

The amount of upward force that must be applied by screwjack 55 need only overcome the weight of right angle brace 10 and provide adequate support for the loading vectors expected for wind loads. This weight is not very great, and the wind chart set forth earlier will readily yield the load vectors to be accommodated while the brace is being held upright by tie wire 60, connector 80 and leveler 55. Accordingly, a simple threaded screwjack riser shaft 54, FIG. 1, of about an inch or so in diameter has proven adequate to satisfy these purposes of our invention.

Riser shaft 54, FIG. 5, slips within a slightly oversized, circular receiving collar 57 welded to horizontal member 30. Leveling is accomplished by advancing or retracting wingnut 58 that is matingly threaded to travel upwards or down on riser shaft 54. Cap 59 covers the exposed end of riser 54 for safety purposes.

Other similar leveling devices, such as manual or hydraulic jacks, or any one of a wide variety of known leveling devices would equally suffice in place of screwjack 55; and, such devices remain within the novel features of our invention. Masonry tradesmen in general are familiar with such screwjack leveling devices as they find extensive use on scaffolding. Thus, in our preferred embodiment we have shown a screwjack 55 rather than some other suitable alternative such as those mentioned above.

Briefly returning again to FIGS. 4 and 5, please note that vertical member 40 has freedom of rotational movement into and away from the wall 11 by a nut/bolt fastener 97 seated within a pair of triangularly-shaped strengthening flanges 99. This fastener 97 may, of course, also take the form of a pin passing through openings in the flange 99 and held there by any well known securing device, such as a pull ring or clip (not shown, but understood in this art).

For leveling purposes at FIG. 5, a workman simply spins (advances and/or lowers) the wing tightener 58 on screwjack shaft 54 until the horizontal brace member 30 is essentially level and the vertical member 40 is flush against wall 11. The workman then finishes securing connector 80 so that the vertical members 40 of our right angle brace invention 10 are snug and flush against the masonry wall 11. Adjusting connector 80 slightly—plus some final adjustments to screwjack 55—readily brings the vertical member(s) of our bracing system invention 10 into a slight compressive condition against the surface of wall 11. If previously loosened, then bolt/nut 97 must also be tightened to bring the brace into a desired state of rigidity for maximum effective support.

At the innermost end, FIG. 4, of the horizontal member 30 we have elected to weld a pair of spaced apart flanges 99 to the horizontal member 30. Obviously, however, member 30 may be bolted or otherwise suitably fastened to the spaced apart flange pair 99. We outfit the other end of that horizontal member 30 with a vertical receiving collar 57, FIG. 5. Receiving collar 57 has an inside diameter that readily accepts an upright threaded shaft 54 of screwjack 55.

Often times work sites face vandalism particularly by juveniles. It would, to idle juveniles, be considered great "fun" to spin the wing nut 58 down on post 54. A simple coupling like a radiator clamp (not shown) may be fastened below wing tightener 58 to deter such vandalism inasmuch as the vandals may not have screwdrivers with them during their "playful" excursion unto the construction site.

FIG. 6 depicts that inner diagonal member 50*i* is slidably seated within outer diagonal member 50*o*. With binding bolt 90 loosened, the inner member 50*i* may be slid out axially from the outer member 50*o*. Bolt 90 may then be made secure and any conventional fastener, 94 such as a cross pin with a ring clip, or a nut and bolt combination may be placed through the mating holes located in both telescoping members 50*i* and 50*o*.

Binding bolt 90 assists in the above-described telescoping feature. That bolt 90 may be loosened and tightened as adjustments are made during the telescoping operation described herein. Additional erection assistance is provided by a lifting pole 110 that has a saddle 111 at its upper end. Saddle 111 is selected with a width and depth that will readily allow the diagonal member 40 to fit within the saddle 111. As workmen are tilting the brace upright, FIG. 3, the lifting pole 110 allows ease of moving the assembled brace into an upright position.

Also note that the top of the inner telescoping member 40*i* has a cover plate 96 that may be separate from—or attached to and made a part of—a wall spacer flange 98. The thickness of the spacer flange 98 compensates for the small amount of separation between the surfaces of the inner and outer members 50*i* and 50*o*, respectively. Spacer flange 98 fits against the wall, and although there may be a small length of the vertical member 40*i* that is not actually flush against the wall, the use of flush in this inventive system takes into account that small degree of separation which does not detract from the brace support features of this invention.

As workmen do masonry work on the scaffolding (not shown) loose wet mortar drops down. Also, as well known, such wet mortar is "pointed", or scraped away at the block seams, during the block laying and joint finishing process for wall 11. The cover cap 97 on the top of the vertical member keeps the dropping mortar from filling the vertical tube sections and interfering with the expected and desired sliding freedom between the telescoping members 40*i* and 40*o*.

Since the height of each newly laid wall section to be braced is foreknown, the telescoped tubes may be appropriately formed with drilled adjustment holes that are aligned so that they may receive connecting bolts or pins. Alternately, of course, a series of spaced length adjustment holes may be placed in each telescoping member pair. The length of a brace member can easily be adjusted as necessary, and the telescoped members (vertical and diagonal) may again be secured together after the required extension to the bracing system has been made.

The method and apparatus of this invention allows scaffolding of conventional type (not shown) to be erected above our inventive bracing system without interfering with the brace sets per se. Our invention increases, in rather dramatic fashion, masonry craftsmen safety while working on block wall 10.

While my invention has been described with reference to particular examples of some preferred embodiments, it is my intention to cover all modifications and equivalents within the scope of the following claims. It is therefore requested that the following claims, which define my invention, be given a liberal interpretation commensurate with my contribution to the relevant technology.

What is claimed is:

1. Apparatus in the form of a pre-assembled unitary right angle brace having interconnected horizontal and vertical strength members rigidly connected at a right angle for bracing a wall being fabricated from masonry blocks above a wall foundation, with said wall having a base-located connector opening through the block wall being fabricated, said apparatus comprising:

an adjustable threaded connector bolt positionable in said opening and extendable through the wall at about the first block course above said wall foundation, said connector having a tightening nut associated therewith;

said rigid unitary right angle brace being loosely connected to said connector bolt at the right angle portion thereof free from any buried in the ground anchor, in order to allow for manual rotation of said unitary right angle brace to a vertical position with a horizontal member of said rotated brace extending away from said wall;

said horizontal member of said unitary brace having an outer end adapted for connection to an adjustable jacking means for tilting the horizontal side of said unitary brace;

said connector tightening nut, when tightened, bringing the vertical member of said pre-assembled brace in non-wall-loading contact against said wall;

manually operable jacking means sitting on the ground and coupled to an outermost end of said horizontal member of said unitary brace for leveling said unitary brace until its vertical brace member is flush against said wall surface and said horizontal member maintains its unitary right angle relationship with said vertical member.

2. The apparatus of claim 1 and further comprising:

said vertical side of said brace is a tubular steel member that is open at a top end and further comprising:

a solid top cap covering said open end of said vertical support member.

3. The apparatus of claim 1 and further comprising;

said jacking means comprises a vertical screw column of a screw jack;

an open cylinder positioned at the outrigger end of the horizontal member of said brace for receiving said vertical column; and said manually operable screwjack means tilts said horizontal brace member until said horizontal brace side is essentially level and said vertical brace side is essentially flush against said wall.

4. The apparatus of claim 3 wherein said horizontal brace member is cantilever connected by said base-located connector bolt and said manually operable jacking means further comprises:

a non-buried load bearing surface plate sitting on the ground; and said vertical screw jack comprises a raising/lowering column vertically oriented on said support plate while engaging the outermost end of said horizontal brace and adjustable there against for tilting the cantilevered horizontal member of said brace.

5. The apparatus of claim 1 wherein said brace further comprises:

tubular steel vertical, horizontal and diagonal support members;

a pair of spaced apart flanges which sandwich and rigidly affix said vertical and horizontal brace support members together into said unitary right angle brace with said connector bolt and tightening nut located in an oversized opening in said vertical member and between said flange pair; and said vertical and said horizontal members each comprise inner and outer telescoping steel members for varying their length in order to accommodate increasing wall height.

* * * * *